US009555865B2

(12) United States Patent
Hansen

(10) Patent No.: US 9,555,865 B2
(45) Date of Patent: Jan. 31, 2017

(54) BOAT COLLAR ATTACHMENT SYSTEM AND METHOD

(71) Applicant: William M. Hansen, Port Orchard, WA (US)

(72) Inventor: William M. Hansen, Port Orchard, WA (US)

( * ) Notice: Subject to any disclaimer, the term of this patent is extended or adjusted under 35 U.S.C. 154(b) by 0 days.

(21) Appl. No.: 14/754,637

(22) Filed: Jun. 29, 2015

(65) Prior Publication Data

US 2015/0375838 A1 Dec. 31, 2015

Related U.S. Application Data

(60) Provisional application No. 62/018,493, filed on Jun. 27, 2014.

(51) Int. Cl.

| | |
|---|---|
| ***B63B 43/14*** | (2006.01) |
| ***B63B 3/08*** | (2006.01) |
| ***B63B 39/00*** | (2006.01) |
| *B63B 59/02* | (2006.01) |

(52) U.S. Cl.

CPC ..... *B63B 43/14* (2013.01); *B63B 3/08* (2013.01); *B63B 39/00* (2013.01); *B63B 59/02* (2013.01)

(58) Field of Classification Search

CPC ..... B63B 43/00; B63B 43/10; B63B 43/14; B63B 3/08; B63B 39/00; B63B 59/02; B63B 43/02

USPC ..... 114/69, 123, 219, 360

See application file for complete search history.

(56) References Cited

U.S. PATENT DOCUMENTS

| | | | | |
|---|---|---|---|---|
| 4,520,746 | A * | 6/1985 | Walters | B63B 43/14 114/123 |
| 5,282,436 | A * | 2/1994 | Hansen | B63B 1/18 114/283 |
| 5,870,965 | A | 2/1999 | Hansen | |
| 6,371,040 | B1 * | 4/2002 | Hemphill | B63B 43/14 114/123 |
| 6,810,827 | B2 | 11/2004 | Hansen | |
| 7,070,730 | B2 | 7/2006 | Hansen | |
| 7,775,172 | B2 | 8/2010 | Hansen | |
| 8,240,268 | B2 | 8/2012 | Hansen | |

* cited by examiner

*Primary Examiner* — Lars A Olson

(74) *Attorney, Agent, or Firm* — Christensen O'Connor Johnson Kindness PLLC

(57) ABSTRACT

A watercraft with outboard stabilizing members on a hull with a bow wrap and port and starboard side sheets with one or more longitudinal channels. The port and starboard stabilizing members comprise buoyant members in a sheath having one or more longitudinal keepers that are configured to be received into the side sheet channels. Tension members extend through the keepers, and are attachable near the aft end of the watercraft, and releasably engage tensioning mechanisms in the bow wrap, for releasably attaching the stabilizing members to the side sheet. Deck access plates through the side walls provide access to the tensioning mechanisms, which may be, for example, crank or electric winch mechanism.

21 Claims, 8 Drawing Sheets

BOAT COLLAR ATTACHMENT SYSTEM AND METHOD

CROSS-REFERENCE TO RELATED APPLICATION

This application claims the benefit of Provisional Application No. 62/018,493, filed Jun. 27, 2014, the disclosure of said application is hereby incorporated by reference.

BACKGROUND

An important advance in the design of smaller, high-performance watercraft in recent years has been the incorporation of buoyant outboard stabilizing members. Such outboard stabilizers help to prevent the watercraft from heeling to far during high-speed maneuvers. Forces experienced by a watercraft during high-speed turns cause the vessel to heel: the sharper the turn and the greater the speed, the greater the angle of heel. In smaller, faster vessels, the heel angle can be extreme, and can even cause the vessel to capsize. Outboard stabilizers, elongate buoyant members fixed to the side sheets or walls of the vessel, are typically positioned high enough on the watercraft to remain out of the water during straight-ahead operation at planing speeds. The foam stabilizers may be disposed at the top of the side sheets or at a location lower on the side sheets. When the vessel heels sufficiently, the heel-side stabilizer engages the water to produce a righting force.

Stabilizing members may rely on polymeric foam for flotation, for example, comprising a solid foam cylinder, a sheathing or flexible container filled with a foam filler material, or a rigid sealed sponson filled with a buoyant material. In other embodiments, the stabilizing member may comprise a gas-filled bladder. Yet other embodiments are formed with both a foam core and gas bladders disposed in an outer sheathing. While air-filled stabilizers are subject to leakage, foam stabilizers have the advantage of being virtually unsinkable, and may be sized to make the associated vessel substantially unsinkable. Outboard stabilizers also provide the watercraft with added buoyancy, thus increasing carrying capacity.

In some embodiments, the outboard stabilizer extends along substantially the entire length of the watercraft, from bow to stern. Alternatively, outboard stabilizers may extend along only a portion of the vessel side sheets. The outboard stabilizer must be securely fixed to the watercraft. Outboard stabilizers on high-performance watercraft are subject to very significant hydrodynamic forces, and it is important that they be fastened securely to the watercraft to withstand these hydrodynamic forces.

Exemplary foam stabilizers are disclosed in U.S. Pat. No. 5,870,965, to Hansen, which is hereby incorporated by reference. Outboard stabilizers utilizing both air and foam for buoyancy are disclosed in U.S. Pat. No. 6,810,827, to Hansen, which is hereby incorporated by reference. Outboard stabilizers may also be provided with features to improve watercraft performance, such as those disclosed in U.S. Pat. No. 7,775,172 and U.S. Pat. No. 8,240,268, also to Hansen, which are hereby incorporated by reference.

One challenge that has limited broader adoption of outboard stabilizers for high-performance watercraft is the additional maximum width, or beam, that results from outboard stabilizers. Watercraft may often be towed or otherwise transported over highways to a desired launch site. Highways generally have limitations on allowable vehicle width. For example, in the United States federal law sets a maximum commercial vehicle width of about 102 inches on the national network of highways (without special overwidth permits) in 23 CFR Part 658.

In order to increase the usable interior space of a towable watercraft having outboard stabilizers, it would be beneficial if the outboard stabilizers could be easily removed during transporting or towing of the vessel, and easily and quickly installed when the vessel arrives at the desired launching location. Prior art attachment mechanisms for outboard stabilizers typically require many hours and trained personnel to remove and reinstall. Such removal and installation may also require special tools and the like. There is a need for improved methods and systems for attaching outboard stabilizers to watercraft.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A watercraft includes a hull having a port side sheet, a starboard side sheet, and a bow having a bow wrap, wherein the port and starboard side sheets each define a longitudinal channel. Port and starboard stabilizing members are provided, and comprise a sheath containing a floatation member. The sheaths include a keeper portion configured to be received into the corresponding longitudinal channel in the side sheet, and the bow wrap receives a forward end of each of the stabilizing members. A pair of tensioning mechanisms are installed in the bow wrap, and engage corresponding tension members that extend through the sheath keeper portions. A forward end of each tension member engages one of the tensioning mechanisms, and an aft end is attached to or near the aft end of the hull, to attach the stabilizing members to the hull.

In an embodiment, the tensioning mechanisms comprise crank or electric winch mechanism.

In an embodiment, the side sheets include removable deck access plates to provide access to the interior of the bow wrap.

In an embodiment, the tension members are elongate straps, with or without relatively rigid members that facilitate installation of the tension members, and a hook member is provided on the aft end to releasably attach the aft end of the tension member to the watercraft.

In an embodiment, a secondary connector mechanism is provided in the bow wrap and on the stabilizing members. The secondary connection mechanism may further be provided at intermittent locations along the length of the stabilizing members.

In an embodiment, each of the stabilizing members comprises a plurality of stabilizing sections that are aligned end to end, and may include connectors for connecting the sections. Preferably the stabilizing sections meet along an interface that makes an acute angle with the watercraft centerline that is between 30 and 60 degrees.

In an embodiment, a stabilizing member for a watercraft having a hull comprising a bow wrap and a side sheet having an outer longitudinal channel and a plurality of removable access plates that sealably engage access apertures through the side sheet, the stabilizing member comprising:

a sheath enclosing a floatation member, wherein the sheath comprises a keeper portion configured to be received into the outer longitudinal channel, and further wherein the bow wrap is configured to receive a forward end of the stabilizing member;

a first tensioning mechanism fixedly installed in the bow wrap;

a tension member configured to extend through the keeper portion and having a forward end configured to adjustably engage the first tensioning mechanism and an aft end configured to be fixedly attached to an aft end of the hull;

wherein the stabilizing member is releasably attached to the hull by the tension member.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
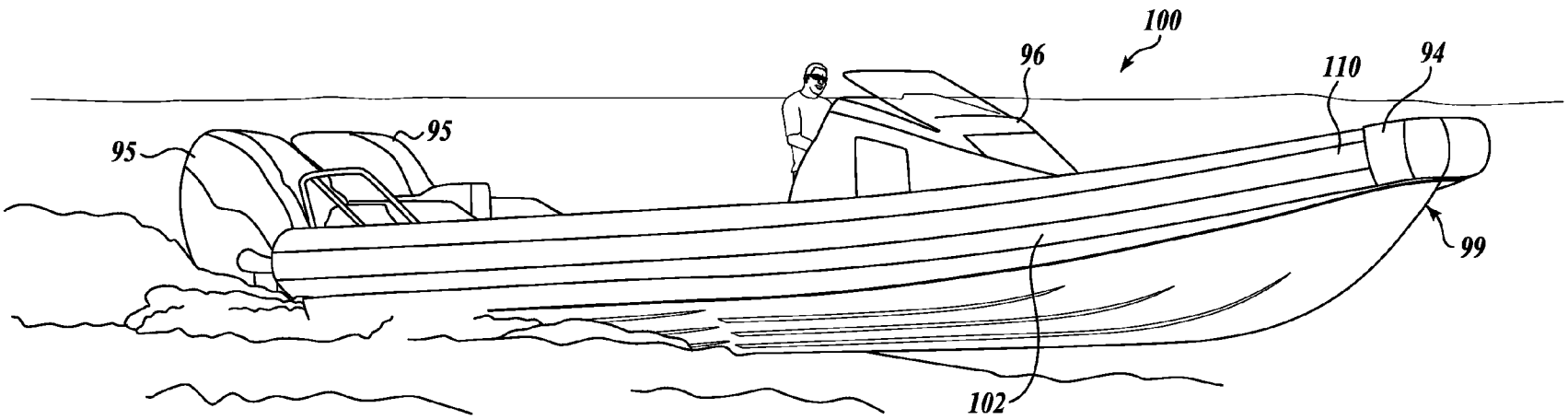
FIG. 1 is a perspective view of a watercraft having outboard stabilizers in accordance with the present invention.

A high-performance watercraft 100 in accordance with the present invention is shown operating at planing speeds in FIG. 1. The watercraft 100 includes a planing hull 99 having oppositely disposed port and starboard outboard stabilizing members 110 (only starboard stabilizing member 110 visible). In this embodiment, the outboard stabilizing members 110 comprise one or more buoyant inserts, for example, polymeric foam inserts, that are enclosed inside a rugged outer membrane or flexible casing. The outboard stabilizing members 110 extend longitudinally along all or most of the length of the planing hull 99, and are securely attached to the hull side sheets 102 with a quick connect system (described below). The quick connect system may comprise, for example, one or more tension members and a tensioning mechanism such as a ratchet or winch. The hull 99 in a current embodiment is formed primarily from aluminum, and may be, for example, 12 feet to 80 feet in length. Other hull sizes and materials are also contemplated.

The stabilizing members 110 are disposed on the upper portion of the side sheets 102, such that the stabilizing members 110 do not engage the water when the watercraft 100 is planing and travelling straight ahead. If the watercraft 100 heels sufficiently, for example, during high-speed turns, or the like, or due to weather and/or water conditions, the stabilizing member 110 on the heel side engages the water to thereby provide additional buoyancy, countering the heeling forces.

In the embodiment of FIG. 1, a control console 96 is disposed approximately mid-ship, and one or more outboard motors 95 provide propulsion. It will be readily apparent to persons of skill in the art that other lengths, construction materials, number and type of motors, and the like, may be used without departing from the present invention.

Figure 2:
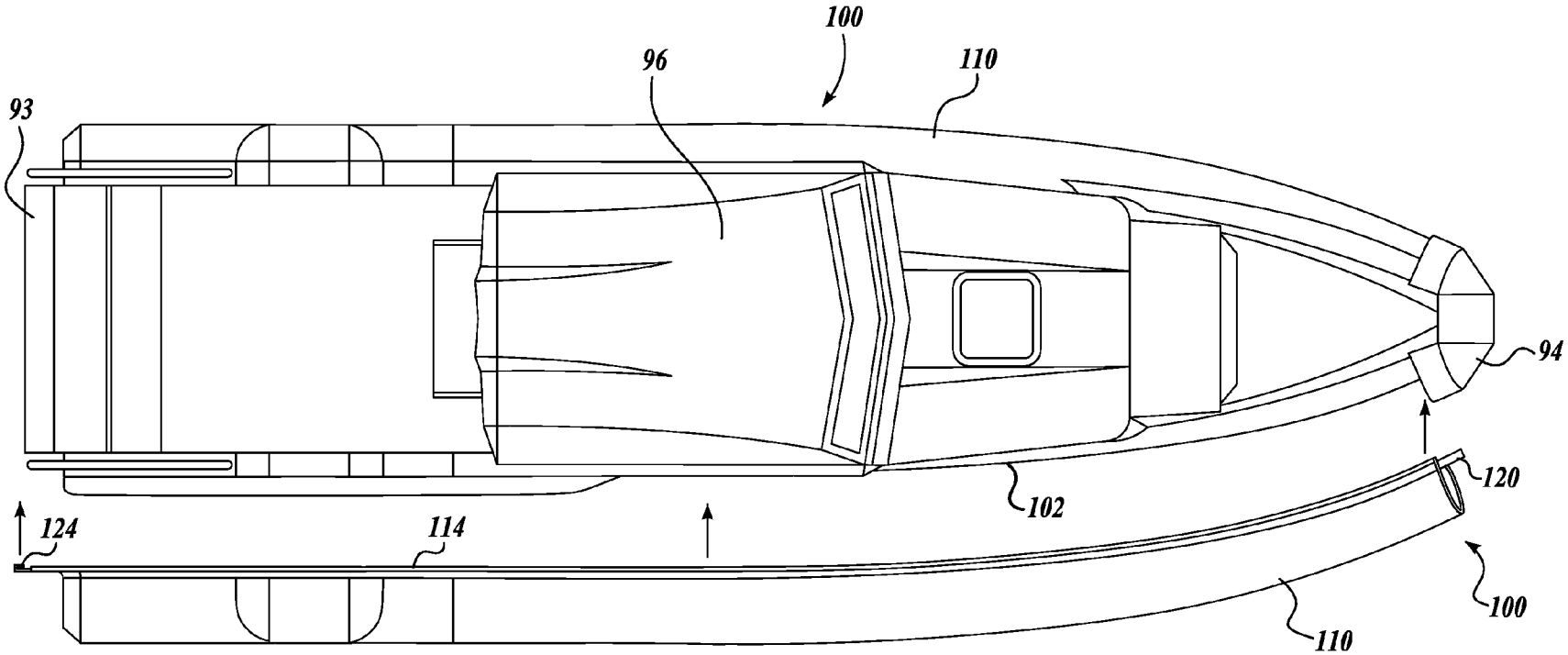
FIG. 2 is a partially exploded plan view of the watercraft shown in FIG. 1, showing one outboard stabilizer removed.

FIG. 2 is a plan view of the watercraft 100 with the starboard stabilizing member 110 in position to be releasably attached to the side sheet 102. The front end of the stabilizing member 110 in this embodiment is configured to be received into a receiver 94, for example, a bow wrap securely fixed to the bow of the watercraft 100.

Figure 3B:
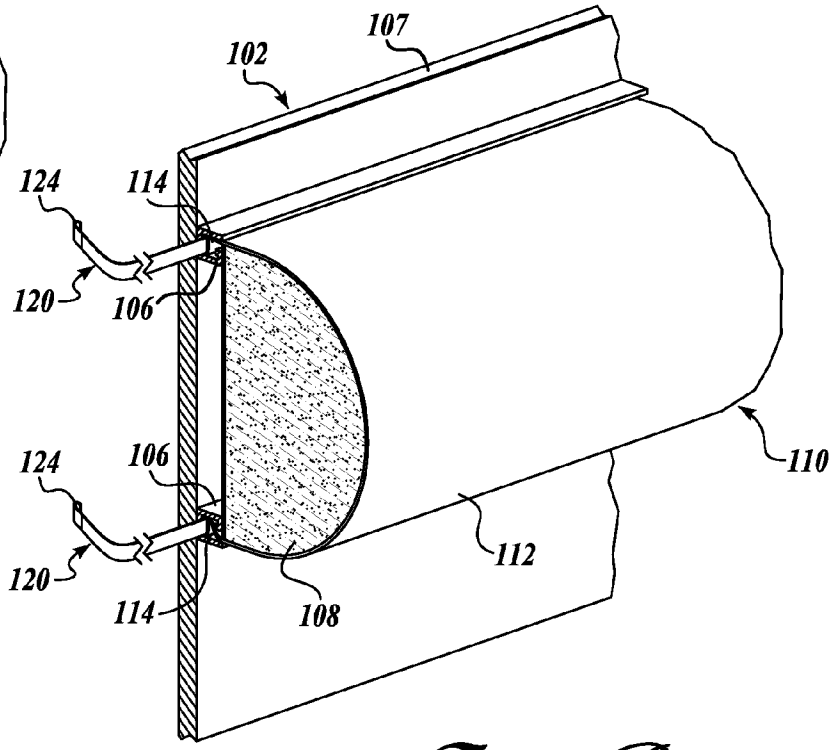
FIG. 3B is a fragmentary unexploded view corresponding to FIG. 3A.
Figure 3A:
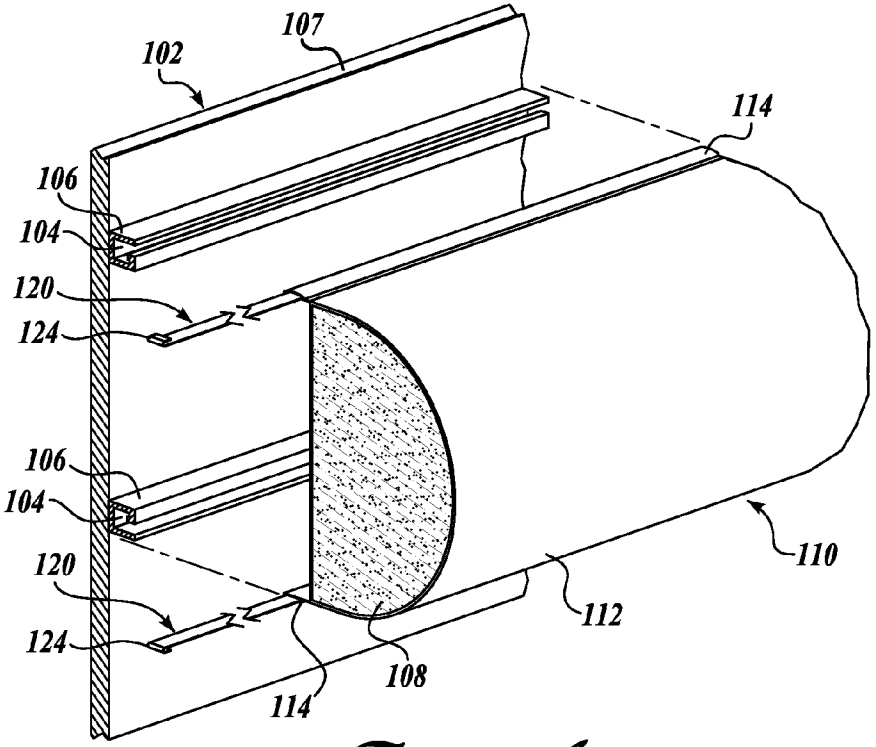
FIG. 3A is a fragmentary view of the stabilizer and side sheet shown in FIG. 2.

A fragmentary exploded sectional detail of the stabilizing member 110, and the watercraft side sheet 102, is shown in FIG. 3A. An unexploded view is shown in FIG. 3B. The stabilizing member 110 in this embodiment includes a foam core 108 enclosed by an outer sheath 112. The foam core 108 may be constructed as a single, unitary member, or may comprise a plurality of longitudinally extending members. In alternative embodiments, the stabilizing members 110 may comprise an outer sheath 112 that is sealed and filled with air or other gas, or the sheath 112 may be partially filled with a buoyant material, for example, a foam material, and partially filled with a gas, which may be provided in a separate bladder. The sheath 112 may be made of a flexible material, for example, a rubberized fabric, and may optionally include internal scaffolding or support structure. Alternatively, the sheath 112 may be a relatively rigid structure, for example, a polymeric or composite tube or thin shell.

The outer sheath 112 includes keeper portions 114 along the upper and lower inboard edges of the sheath 112. Elongate tension members 120, for example, webbing, cable, rope, or the like, extend through the keeper portions 114. It is contemplated that the tension member 120 may include or consist of a relatively rigid or semi-rigid rod (not shown) to facilitate insertion of the tension members 120 into the keeper portions 114.

In this embodiment, the associated hull side sheet 102 includes upper and lower, outwardly open elongate channels 104 that are sized and configured to receive the keeper portions 114 of the sheath 112 with the inserted tension members 120. The channels 104 may be formed integrally with the side sheet 102 or, as in the current embodiment, may be defined by one or more members fixed to the side sheet 102, for example, aluminum extrusions 106. The extrusions 106 may be fixed to the side sheet 102 by any conventional means, for example, by welding, or with rivets, bolts, adhesives, or the like. In an alternative embodiment, the upper channel 104 may be formed on the gunwale 107.

Figure 4:
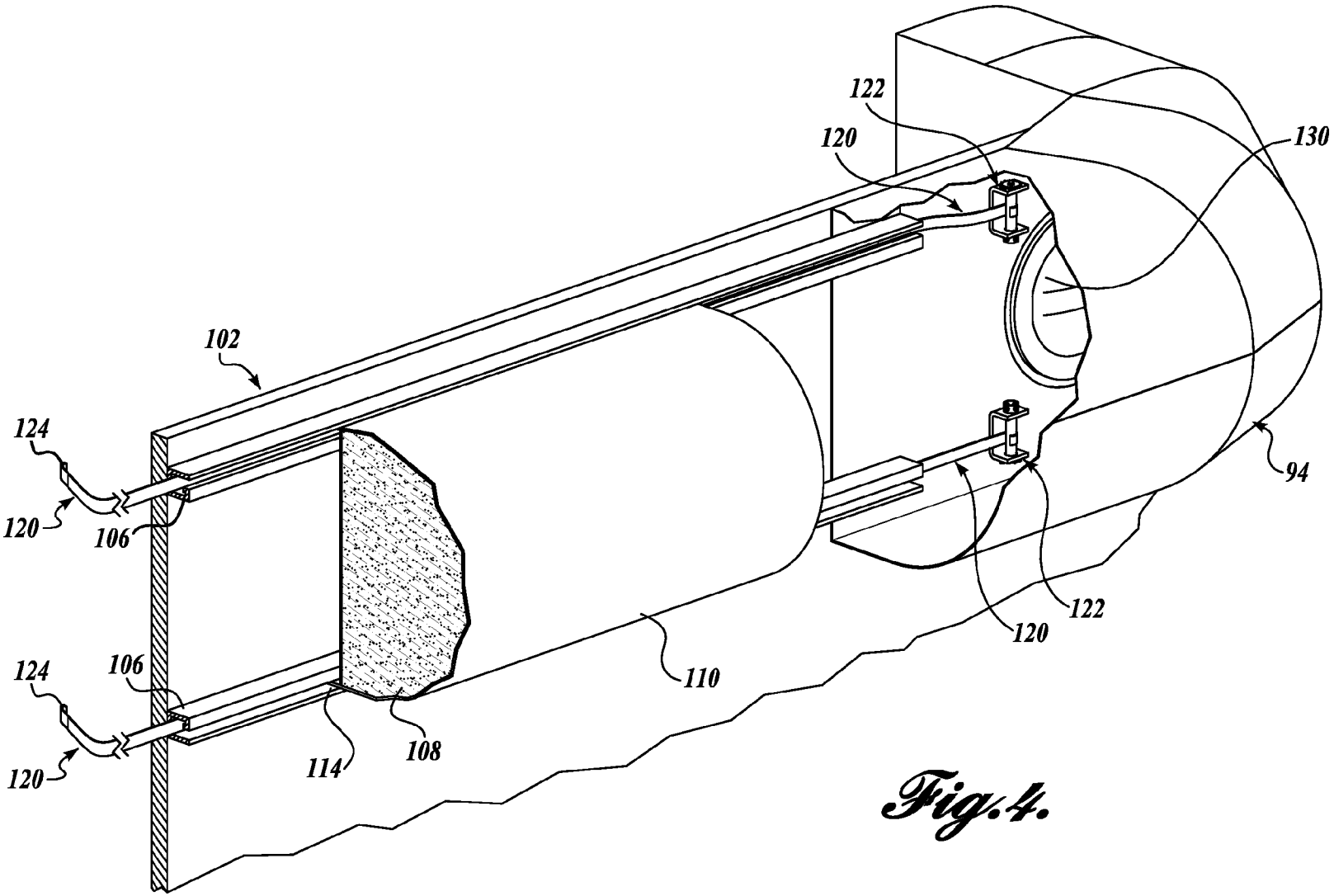
FIG. 4 is a fragmentary sectional view showing the stabilizer in position to be attached to the watercraft side sheet and receiver.

FIG. 4 is a fragmentary cross section of the forward-starboard side of the watercraft 100 looking towards the bow, with the forward end of the starboard stabilizing member 110 positioned to be moved into engagement with the receiver 94 and with the side sheet 102. The stabilizing member 110 is smaller in circumference than the opening defined by the receiver 94, such that the stabilizing member 110 may be readily inserted therein. A deck access plate 130, sometimes referred to as a pie-eye, provides a watertight seal through the side sheet 102, and can be removed to provide access to the interior of the receiver 94. Such deck access plates 130 are known in the art. A pair of tensioning mechanisms 122, for example, ratchets, winches, eccentric mechanisms, or the like, are installed in the receiver 94 and positioned to receive and engage a forward end of the tension members 120.

The aft end of each tension member 120 is provided with a connector 124, for example, a hook, latch member, or other conventional means for securing the aft end of the tension member 120 at or near the transom 93 (FIG. 2). Preferably the tension member 120 and connector 124 extend around the edge of the transom 93. In a current embodiment, the connector 124 is a hook that is configured to be attached to a retainer (not shown) disposed on the transom 93. Alternatively, the upper and lower tension members 120 may be formed as a single strap or line that extends through the lower keeper portion 114, around an aft end of the stabilizer member 110, and back through the upper keeper portion 114.

To attach the stabilizing member 110 to the side sheet 102, the tension members 120 are inserted into the corresponding keeper portions 114 of the sheath 112. As discussed above, a rod or other rigid or semi-rigid member may be used to guide the tension members 120 into the keeper portions 114.

A forward end of each tension member 120 is positioned to engage the corresponding tensioning mechanism 122. The stabilizing member 110 engages the receiver 94, such that the stabilizing member 110 is disposed along the side sheet 102, adjacent the extrusions 106. It is contemplated that the stabilizing member 110 may be sized and shaped such that an inner surface is disposed against the side sheet 102 between the extrusions 106. In an alternative embodiment, the extrusions 106 are recessed in the side sheet 102 such that they are substantially flush with the side sheet 102. The keeper portions 114 with the tension members 110 slidably disposed therein are positioned in the channels 104. The aft end connector 124 of the tension members 120 are secured to the watercraft 100 near the aft end of the stabilizer 110. The deck access plate 130 is removed, providing access to the tensioning mechanisms 122, and the tension members 120 are pulled taut with the tensioning mechanisms 122, thereby securely fixing the stabilizing member to the hull 99. The deck access plate 130 is then reinstalled.

The stabilizing member 110 may be easily removed by removing the deck access plate 130 and releasing the tension member 120 from the tensioning mechanism 122.

Figures 5A, 5B:
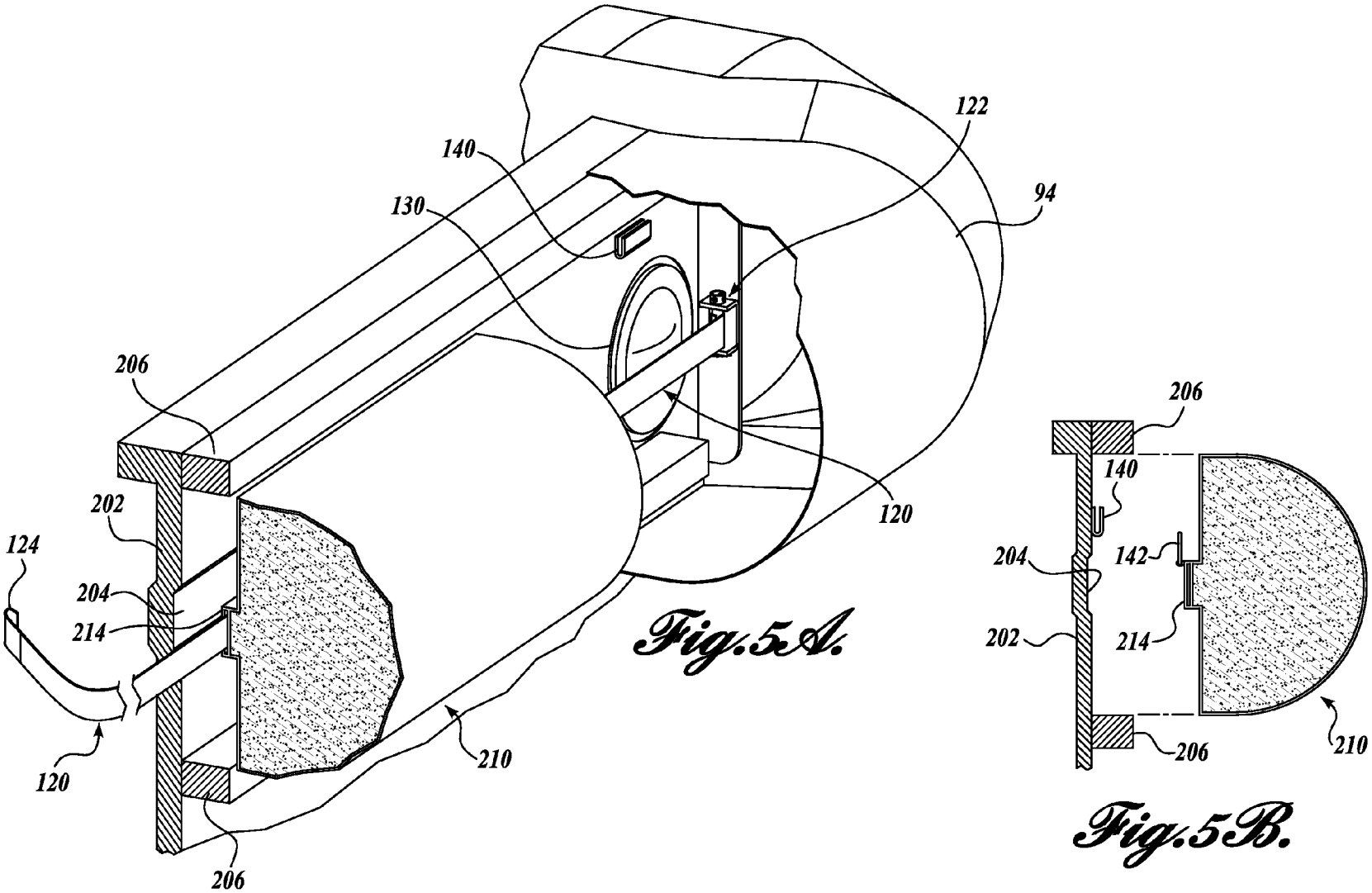
FIG. 5A is a fragmentary sectional view of a secondary embodiment of a stabilizer in accordance with the present invention, positioned to be attached to a watercraft side sheet using a single tension member.
FIG. 5B is a fragmentary cross-sectional view of the stabilizer shown in FIG. 5A.
Figure 6:
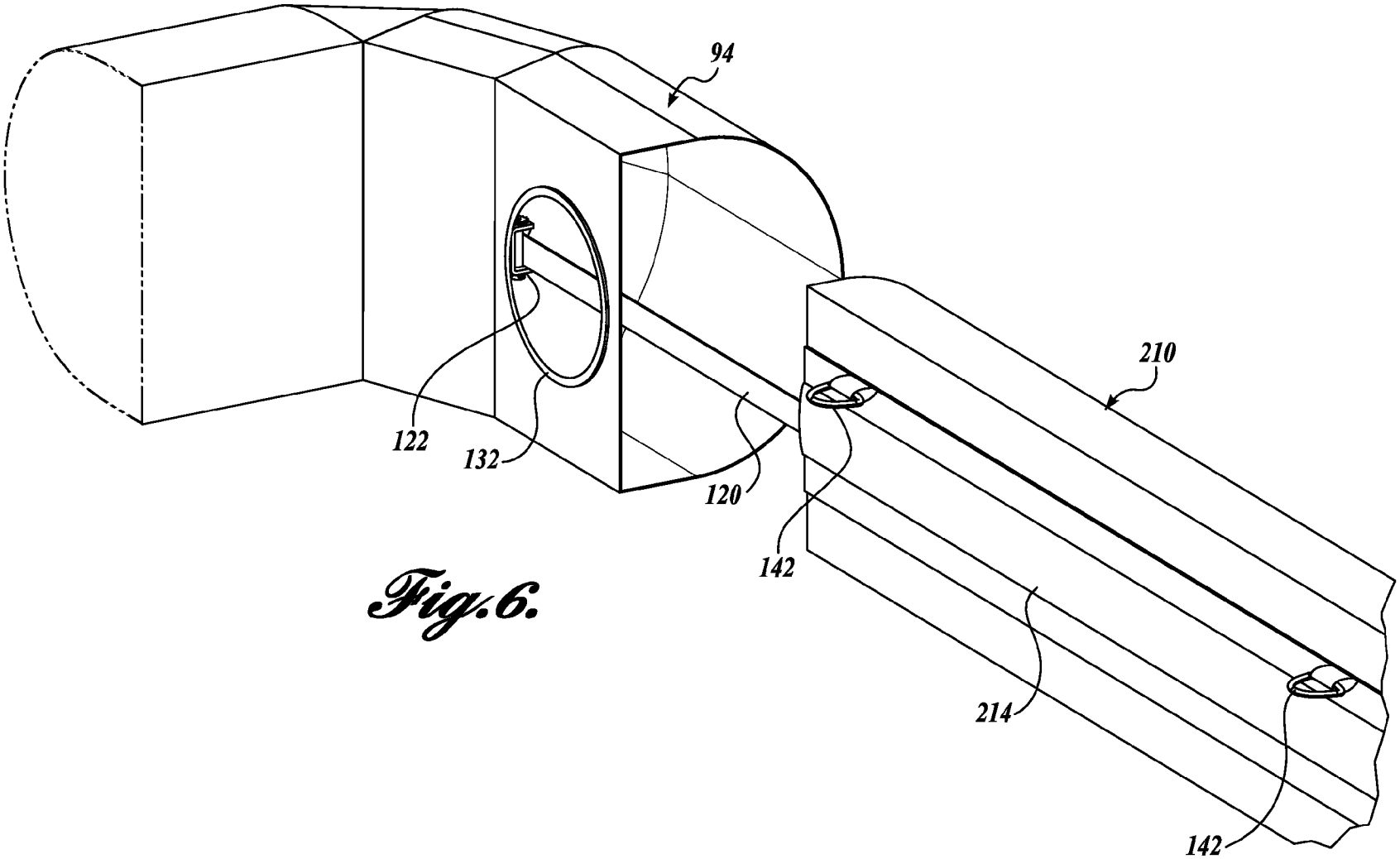
FIG. 6 is a partially exploded fragmentary view of the stabilizer shown in FIG. 5A and a portion of the receiver, wherein the watercraft side sheet is removed for clarity.

A fragmentary view of an alternative embodiment for releasably attaching stabilizing members 210 to the watercraft 100 (starboard side) is shown in FIGS. 5A-6. In this embodiment, upper and lower flanges 206 are defined on the outboard side of the side sheet 202. The flanges 206 may be co-formed with the side sheet 202 or fixed to the side sheet 202, for example, by welding. A narrow, elongate recess or channel 204 is centrally located between the upper and lower flanges 206. In this embodiment, the channel 204 is formed as a corrugation in the side sheet 202. The flanges 206 are spaced apart and configured to receive the stabilizing member 210.

The stabilizing member 210 is releasably fixed to the watercraft side sheet 202 with a single, centrally positioned tension member 120 that extends through an elongate keeper portion 214 on the inboard side of the stabilizing member 210. The keeper portion 214 and tension member 120 are sized to be received in the central channel 204. The connector 124 fixes the aft end of the tension member 120 to or near the aft end of the watercraft 100.

An advantage of this second embodiment is the stabilizing member 210 is positioned between the flanges 206, thereby protecting the stabilizing member 210 from damage, for example, by hydrodynamic forces during operation of the watercraft 100.

Optionally, a latch member 140, for example, a U-shaped hook member, is fixed to the side sheet 202 above the access plate 130. The latch member 140 is positioned to engage a corresponding engagement member such as a D-ring 142 (FIG. 5B).

FIG. 6 is a fragmentary view of the receiver 94 and stabilizing member 210 in isolation, with the access plate 130 removed, providing access to the bow wrap or receiver 94 through the opening 132. The stabilizing member 210 is positioned to have a forward end inserted into the receiver 94. In this embodiment, the stabilizing member 210 is provided with a plurality of D-rings 142. The forward D-ring 142 is sized and positioned to releasably engage latch members 140 disposed on the outboard side of the side sheet 202 (FIG. 5A).

In this embodiment, additional access plates 130 are installed at spaced-apart locations along the side sheet 202, and corresponding latch members 140 are installed on the outboard side of the side sheet 202. The access plates 130 and latch members 140 are positioned to engage corresponding D-rings 142 on the stabilizing members 210. It will be appreciated that the latching assembly 140, 142 may be implemented in a number of different ways. For example, a more secure engagement may be accomplished by replacing the U-shaped latch members 140 with a closure mechanism having a positive engagement, for example, a carabiner, or the like. In another alternative, a twist and lock mechanism may be incorporated into the stabilizer and side sheet. Other options will be apparent to persons of skill in the art.

The latch assemblies 140, 142 provide a secondary securement of the stabilizing members 210 to the side sheets 202, and facilitate installation and removal by holding the corresponding stabilizing member 210 in position before and after the tension member 120 is tightened. The latch assemblies 140, 142 also provide redundancy for retaining the outboard stabilizing members 210, in the event of failure of the primary tension members 120.

The assembled stabilizing member 210 is readily installed as follows: (i) removing the access plates 130, (ii) connecting the forward end of the tension member 120 to the tensioning mechanism 122 installed in the receiver 94, (iii) inserting the forward end of the stabilizing member 210 into the receiver 94 with the stabilizing member 210 disposed between the flanges 206, (iv) connecting the latch assemblies 140, 142, (v) tightening the tension member 120 to secure the stabilizing member between the flanges 206, and (vi) replacing the access plates 130. The stabilizing member 210 may similarly be easily removed.

Figure 7:
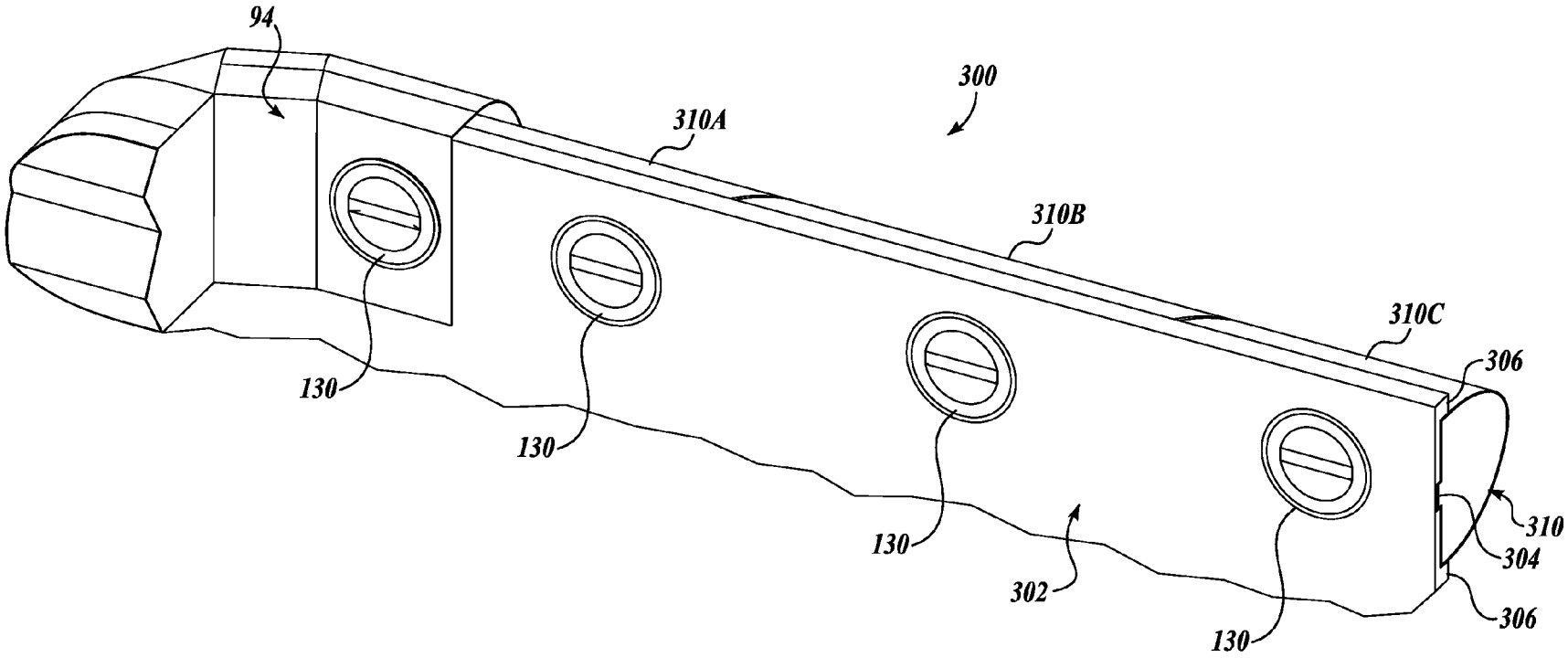
FIG. 7 is a fragmentary view of a third embodiment of a stabilizer in accordance with the present invention similar to the embodiment shown in FIG. 5A, but wherein the stabilizer is formed in multiple segments.
Figure 8:
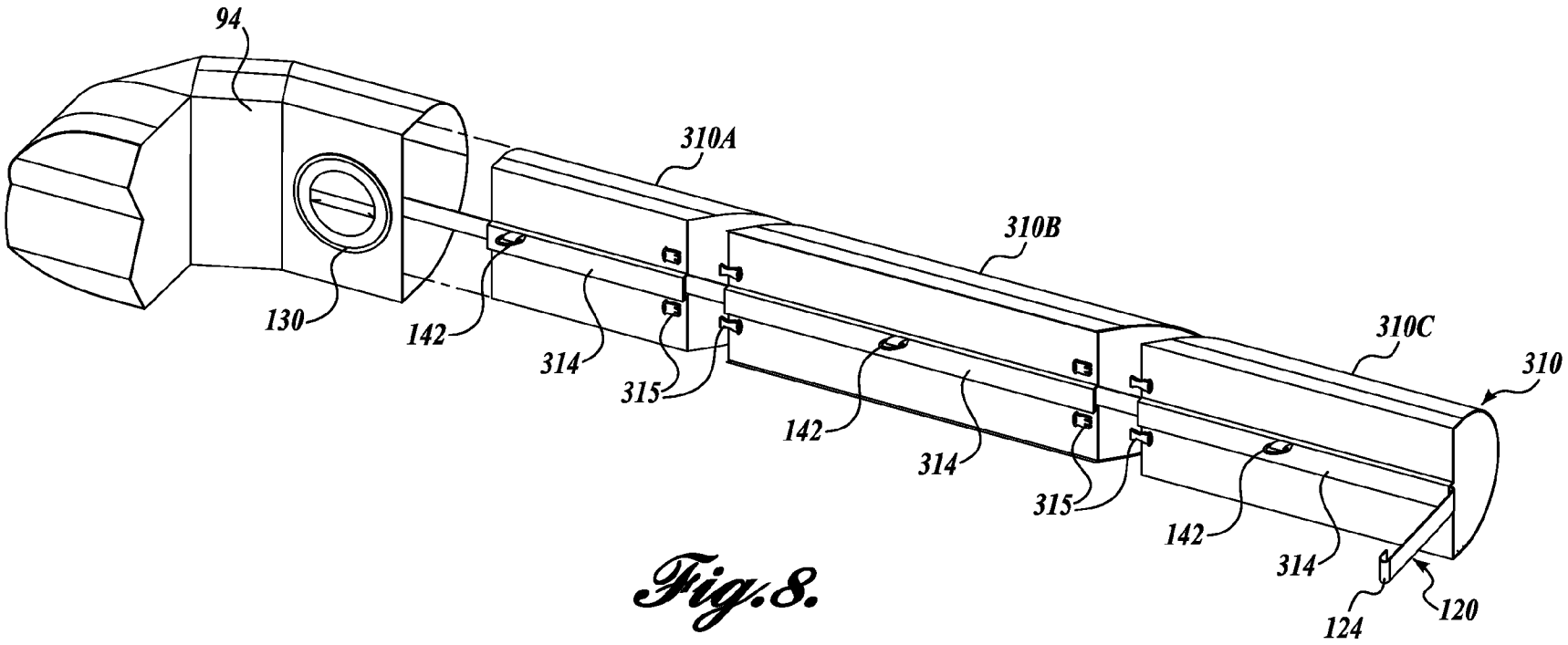
FIG. 8 shows the stabilizer shown in FIG. 7 and a portion of the receiver, with the vessel side sheet removed.

A third embodiment of a quick release stabilizing member 300 is illustrated in FIGS. 7 and 8. This embodiment is similar to the embodiment described above with reference to FIGS. 5A-6, but wherein the stabilizer assembly 310 comprises a plurality of separable segments 310A, 310B, and 310C. FIG. 7 is a fragmentary view of a portion of the starboard side of a watercraft 300. An upper portion of the side sheet 302 receives and retains the sectional outboard stabilizer assembly 310. Upper and lower outboard flanges 306 define a channel that receives the sectional outboard stabilizer assembly 310, such that the flanges 306 extend over the upper and lower edges of the stabilizer assembly 310.

The side sheet 302 includes spaced apart deck access plates 130 that are removable to provide access through the side sheet 302 to the channel defined between the flanges 306. An elongate recess 304 is defined similar to the channel 204 discussed above, to receive a tension member 120. For example, a slotted plate may be fixed at the aft end of the elongate recess 304 for securement of the connector 124 on the end of the tension member 120.

FIG. 8 shows the view from FIG. 7, with the side sheet 302 removed to show the sectional stabilizer assembly 310, which is shown in exploded view. Although the sectional stabilizer assembly 310 shown in FIGS. 7 and 8 has three sections 310A, 310B, 310C, more or fewer sections are contemplated.

As seen most clearly in FIG. 8, the sections 310A, 310B, 310C are formed such that adjacent surfaces between the sections are disposed at an angle of about 45 degrees (e.g., between 30 degrees and 60 degrees) with respect to the center plane of the watercraft 300. This angled joint provides protection from hydrodynamic forces during operation of the watercraft 300 at high speeds.

Each of the sections 310A, 310B, and 310C may comprise an outer, flexible envelope or sheath that encloses a buoyant material, for example, foam. Each of the sections 310A, 310B, and 310C have a central keeper portion 314 that is sized and configured to receive the tension member 120, and positioned to be received into the elongate recess 304 in the side sheet 302.

Latch members, for example, the D-rings 142 discussed above, or other types of latches, e.g., carabiner instead of a U-shaped hook providing a positive more secure capture of the D-rings, are provided to engage with corresponding latch members 140 (FIG. 5A) provided on the side sheet 302 and accessible through apertures when the deck access plates 130 are removed. Releasable clips 315, as are well known in the art, are fixed to the sections 310A, 310B, 310C to join the adjacent sections.

The present invention provides a safe and stable high performance vessel with a quick release and secure installation of outboard stabilizing members.

Although currently preferred embodiments are disclosed and illustrated in the figures, it will be appreciated that various changes could be made without departing from the present invention. For example, the tensioning mechanisms may be fixed to the watercraft near the aft end of the stabilizing members, and the forward end of the tension members may be hooked or latched near the bow of the watercraft. A crank or electric winch mechanism may be used to tighten the tension members. More than two tension members may be used to releasably secure the stabilizing members to the watercraft.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A watercraft comprising:

a hull having a port side sheet, a starboard side sheet, and a bow having a bow wrap, wherein the port and starboard side sheets each define a longitudinal channel;

a port stabilizing member and a starboard stabilizing member, each stabilizing member comprising a sheath containing a floatation member, wherein the sheath comprises a keeper portion configured to be received into the corresponding longitudinal channel, and further wherein the bow wrap is configured to receive a forward end of each of the port and starboard stabilizing members;

a first tensioning mechanism fixedly installed in the bow wrap and a second tensioning mechanism fixedly installed in the bow wrap;

a port tension member configured to extend through the port stabilizing member sheath keeper portion and having a forward end configured to adjustably engage the first tensioning mechanism and an aft end configured to be fixedly attached to an aft end of the hull, and a starboard tension member configured to extend through the starboard stabilizing member sheath keeper portion and having a forward end configured to adjustably engage the second tensioning mechanism and an aft end configured to be fixedly attached to the aft end of the hull;

wherein the port stabilizing member is releasably attached to the hull by the port tension member and the starboard stabilizing member is releasably attached to the hull by the starboard tension member.

2. The watercraft of claim 1, wherein the first and second tensioning mechanisms comprise crank or electric winch mechanisms.

3. The watercraft of claim 1, wherein the port side sheet further comprises a removable deck access plate positioned to provide access through the port side sheet to an interior of the bow wrap.

4. The watercraft of claim 1, wherein the port tension member comprises an elongate strap.

5. The watercraft of claim 4, wherein the port tension member further comprises an insertion rod.

6. The watercraft of claim 4, wherein the port tension member aft end further comprises a hook member that is configured to engage an aft end of the watercraft.

7. The watercraft of claim 1, further comprising a connector mechanism comprising a first connector member fixedly installed in the bow wrap and a second connector member fixed to the keeper portion of the port stabilizing member sheath, wherein the first and second connector members are positioned to provide a secondary attachment of the port stabilizing member to the hull.

8. The watercraft of claim 1, further comprising a plurality of first connector members distributed longitudinally along an outer face of the port side sheet, and configured to engage a plurality of second connector members distributed longitudinally along the keeper portion of the port stabilizing member sheath, wherein the plurality of first and second connector members are positioned to provide secondary attachment of the port stabilizing member to the hull.

9. The watercraft of claim 8, further comprising a plurality of a removable deck access plates positioned to provide access through the port side sheet to the plurality of first and second connector members.

10. The watercraft of claim 1, wherein the each of the port and starboard stabilizing members comprising separable stabilizer sections that are configured to be aligned end to end during installation.

11. The watercraft of claim 10, wherein each of the port stabilizing member stabilizer sections further comprise connectors that are configured to connect the port stabilizing member stabilizer sections to each other end to end.

12. The watercraft of claim 1, wherein the port and starboard keeper portions are disposed along an upper edge of the associated sheath, and the port and starboard stabilizing member sheaths further comprise a second keeper portion disposed along a lower edge of the associated sheath, and further comprising additional tensioning mechanisms installed in the bow wrap and additional tension members configured to extend through the second keeper portions and to engage the additional tensioning mechanisms.

13. A stabilizing member for a watercraft having a hull comprising a bow wrap and a side sheet having an outer longitudinal channel and a plurality of removable access plates that sealably engage access apertures through the side sheet, the stabilizing member comprising:

a sheath enclosing a floatation member, wherein the sheath comprises a keeper portion configured to be received into the outer longitudinal channel, and further wherein the bow wrap is configured to receive a forward end of the stabilizing member;

a first tensioning mechanism fixedly installed in the bow wrap;

a tension member configured to extend through the keeper portion and having a forward end configured to adjustably engage the first tensioning mechanism and an aft end configured to be fixedly attached to an aft end of the hull;

wherein the stabilizing member is releasably attached to the hull by the tension member.

14. The stabilizing member of claim 13, wherein the tensioning mechanism comprises a crank or electric winch mechanism.

15. The stabilizing member of claim 13, wherein the side sheet further comprises a removable deck access plate positioned to provide access through the side sheet to an interior of the bow wrap.

16. The stabilizing member of claim 13, wherein the tension member comprises an elongate strap.

17. The stabilizing member of claim 16, wherein the tension member further comprises an insertion rod.

18. The stabilizing member of claim 16, wherein the tension member aft end further comprises a hook member that is configured to engage an aft end of the watercraft.

19. The stabilizing member of claim 13, further comprising a connector mechanism comprising a first connector member fixedly installed in the bow wrap and a second connector member fixed to the keeper portion of the stabilizing member sheath, wherein the first and second connector members are positioned to provide a secondary attachment of the stabilizing member to the hull.

20. The stabilizing member of claim 12, wherein the stabilizing member comprises separable stabilizer sections that are configured to be aligned end to end during installation.

21. The stabilizing member of claim 20, wherein each of the stabilizing member stabilizer sections further comprise connectors that are configured to connect the stabilizing member stabilizer sections to each other end to end.

* * * * *